US011017914B2

(12) United States Patent
Inoue et al.

(10) Patent No.: US 11,017,914 B2
(45) Date of Patent: May 25, 2021

(54) COVERED ELECTRIC WIRE, TERMINAL-FITTED ELECTRIC WIRE, COPPER ALLOY WIRE, AND COPPER ALLOY STRANDED WIRE

(71) Applicants: Sumitomo Electric Industries, Ltd., Osaka-shi (JP); AutoNetworks Technologies, Ltd., Yokkaichi (JP); Sumitomo Wiring Systems, Ltd., Yokkaichi (JP)

(72) Inventors: Akiko Inoue, Osaka (JP); Kei Sakamoto, Osaka (JP); Tetsuya Kuwabara, Osaka (JP); Taichiro Nishikawa, Osaka (JP); Kiyotaka Utsunomiya, Osaka (JP); Yusuke Oshima, Osaka (JP); Yasuyuki Ootsuka, Yokkaichi (JP); Kinji Taguchi, Yokkaichi (JP); Hiroyuki Kobayashi, Yokkaichi (JP); Ryoma Uegaki, Yokkaichi (JP)

(73) Assignees: Sumitomo Electric Industries, Ltd., Osaka (JP); AutoNetworks Technologies, Ltd., Yokkaichi (JP); Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 16/075,287

(22) PCT Filed: Jan. 20, 2017

(86) PCT No.: PCT/JP2017/001911

§ 371 (c)(1),
(2) Date: Aug. 3, 2018

(87) PCT Pub. No.: WO2017/135072

PCT Pub. Date: Aug. 10, 2017

(65) Prior Publication Data

US 2019/0066864 A1 Feb. 28, 2019

(30) Foreign Application Priority Data

Feb. 5, 2016 (JP) ..... 2016-021224

(51) Int. Cl.
*H01B 1/02* (2006.01)
*C22C 9/00* (2006.01)
(Continued)

(52) U.S. Cl.
CPC ..... *H01B 1/026* (2013.01); *C22C 9/00* (2013.01); *C22F 1/08* (2013.01); *H01B 7/0009* (2013.01);
(Continued)

(58) Field of Classification Search
None
See application file for complete search history.

(56) References Cited

U.S. PATENT DOCUMENTS 5,176,740 A * 1/1993 Miura ..... C22C 1/0416 420/529
2002/0157741 A1* 10/2002 Yamamoto ..... C22F 1/08 148/685

(Continued)

FOREIGN PATENT DOCUMENTS

JP 2014-156617 A 8/2014
WO 2014/125677 A1 8/2014
WO 2015/064357 A1 5/2015

OTHER PUBLICATIONS

"Wikipedia." Strain_hardening_exponent. 2020. , Tabluation of n and K Values for Several Alloys (2014 via References) (Year: 2020).*

*Primary Examiner* — Binh B Tran
*Assistant Examiner* — Muhammed Azam
(74) *Attorney, Agent, or Firm* — Baker Botts L.L.P.; Michael A. Sartori

(57) ABSTRACT

A covered electric wire comprises an insulating coating layer on the outer side of a conductor. The conductor
(Continued)

comprises a copper alloy consisting of: not less than 0.05% by mass and not more than 2.0% by mass of Fe; not less than 0.02% by mass and not more than 1.0% by mass of Ti; not less than 0% by mass and not more than 0.6% by mass of Mg; and the balance being Cu and impurities. The covered electric wire is a stranded wire comprising a plurality of copper alloy wires stranded together. The plurality of copper alloy wires each have a work hardening coefficient of not less than 0.1 and a wire diameter of not more than 0.5 mm.

9 Claims, 2 Drawing Sheets

(51) Int. Cl.

| | |
|---|---|
| ***C22F 1/08*** | (2006.01) |
| ***H01B 7/00*** | (2006.01) |
| ***H01B 7/18*** | (2006.01) |
| ***H01B 13/00*** | (2006.01) |
| ***H01B 13/02*** | (2006.01) |
| ***H01B 13/24*** | (2006.01) |
| ***H01R 4/18*** | (2006.01) |

(52) U.S. Cl.
CPC ..... *H01B 7/18* (2013.01); *H01B 13/0016* (2013.01); *H01B 13/0285* (2013.01); *H01B 13/0292* (2013.01); *H01B 13/24* (2013.01); *H01R 4/185* (2013.01)

(56) References Cited

U.S. PATENT DOCUMENTS

| | | | | |
|---|---|---|---|---|
| 2006/0016528 | A1* | 1/2006 | Hatakeyama | C22C 9/02 148/684 |
| 2007/0131321 | A1* | 6/2007 | Kaneko | C22C 9/06 148/685 |
| 2009/0010797 | A1* | 1/2009 | Aruga | C22C 9/00 420/472 |
| 2009/0084473 | A1* | 4/2009 | Aruga | C22C 9/02 148/554 |
| 2010/0294534 | A1* | 11/2010 | Mihara | C22C 9/06 174/126.1 |
| 2012/0018192 | A1* | 1/2012 | Takahashi | C22C 9/04 174/128.1 |
| 2013/0225017 | A1* | 8/2013 | Kubodera | C22C 9/06 439/887 |
| 2015/0200033 | A1* | 7/2015 | Sumino | C22C 9/00 420/476 |
| 2015/0371726 | A1* | 12/2015 | Inoue | H01B 1/026 174/74 R |
| 2016/0254074 | A1* | 9/2016 | Kobayashi | C22C 9/00 174/74 R |
| 2016/0284437 | A1* | 9/2016 | Inoue | B22D 21/005 |
| 2016/0336086 | A1* | 11/2016 | Inoue | C22C 9/00 |
| 2016/0368035 | A1* | 12/2016 | Kobayashi | H01B 1/026 |
| 2017/0040081 | A1* | 2/2017 | Kobayashi | C22C 9/00 |
| 2018/0105913 | A1* | 4/2018 | Lass | C22C 1/02 |
| 2018/0114610 | A1* | 4/2018 | Uegaki | H01B 7/0291 |
| 2018/0211741 | A1* | 7/2018 | Matsunaga | H01B 1/026 |
| 2019/0066864 | A1* | 2/2019 | Inoue | H01R 4/185 |
| 2019/0355489 | A1* | 11/2019 | Sakamoto | H01B 1/026 |
| 2019/0360074 | A1* | 11/2019 | Sakamoto | C22C 9/02 |

* cited by examiner

COVERED ELECTRIC WIRE, TERMINAL-FITTED ELECTRIC WIRE, COPPER ALLOY WIRE, AND COPPER ALLOY STRANDED WIRE

TECHNICAL FIELD

The present invention relates to: a copper alloy wire and a copper alloy stranded wire which are each used as a conductor of an electric wire or the like; a covered electric wire which includes the copper alloy wire or copper alloy stranded wire as a conductor; and a terminal-fitted electric wire which includes the covered electric wire. The present application claims a priority based on Japanese Patent Application No. 2016-021224 filed on Feb. 5, 2016, the entire content of which is incorporated herein by reference.

BACKGROUND ART

Conventionally, a wire harness made up of a plurality of bundled terminal-fitted electric wires is used for a wire structure of an automobile, an industrial robot and the like. Each of the terminal-fitted electric wires has a conductor exposed at its end with a terminal (e.g. crimp terminal) being attached to the conductor. Typically, each terminal is inserted into a corresponding one of a plurality of terminal holes provided in a connector housing, thereby mechanically connected to the connector housing. Through this connector housing, an electric wire is connected to an apparatus body. Connector housings may be connected together so as to connect electric wires together.

A prevailing material constituting the above-described conductor is a copper-based material, such as copper, which is excellent in electrical conductivity. Japanese Patent Laying-Open No. 2014-156617 (PTD 1) discloses a thin copper alloy wire that is high in strength and electrical conductivity and also excellent in elongation, as a copper alloy wire suitable for use in automobiles.

CITATION LIST

Patent Document

PTD 1: Japanese Patent Laying-Open No. 2014-156617

SUMMARY OF INVENTION

A covered electric wire according to one aspect of the present invention is a covered electric wire comprising an insulating coating layer on an outer side of a conductor, the conductor comprising a copper alloy consisting of:

not less than 0.05% by mass and not more than 2.0% by mass of Fe;

not less than 0.02% by mass and not more than 1.0% by mass of Ti;

not less than 0% by mass and not more than 0.6% by mass of Mg; and the balance being Cu and impurities, the covered electric wire being a stranded wire comprising a plurality of copper alloy wires stranded together, the plurality of copper alloy wires each having a work hardening coefficient of not less than 0.1 and a wire diameter of not more than 0.5 mm.

A terminal-fitted electric wire according to one aspect of the present invention comprises: the covered electric wire according to the above-described aspect; and a terminal attached to an end of the covered electric wire.

A copper alloy wire according to one aspect of the present invention is a copper alloy wire to be used as a conductor, the copper alloy wire comprising a copper alloy consisting of:

not less than 0.05% by mass and not more than 2.0% by mass of Fe;

not less than 0.02% by mass and not more than 1.0% by mass of Ti;

not less than 0% by mass and not more than 0.6% by mass of Mg; and the balance being Cu and impurities, the copper alloy wire having a work hardening coefficient of not less than 0.1, and a wire diameter of not more than 0.5 mm.

A copper alloy stranded wire according to one aspect of the present invention comprises a plurality of the copper alloy wires according to the above-described aspect stranded together.

DESCRIPTION OF EMBODIMENTS

Figure 1:
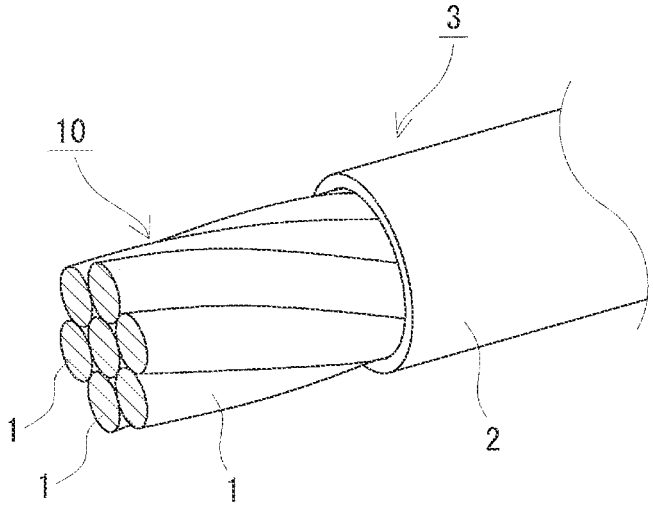
FIG. 1 is a schematic perspective view showing a covered electric wire in an embodiment.

Problem to be Solved by the Present Disclosure

It is desired that an electric wire used in a state where a terminal is attached thereto (hereinafter also referred to as a terminal-attached state) should not let the terminal come off easily when subject to impact, and should exhibit a good terminal-fixing property. Also, it is desired that the electric wire with a terminal being attached thereto should not break easily at and around the terminal-attached portion of the conductor when subject to impact. That is, it is desired that the electric wire should exhibit a good impact resistance even in the terminal-attached state.

For example, if a crimp terminal is attached to a conductor at an end of an electric wire, the conductor and the wire barrel portion of the crimp terminal are compressed at the same time. This compression makes the terminal-attached portion of the conductor smaller in cross-sectional area than a portion other than the terminal-attached portion (hereinafter also referred to as a main wire portion). Accordingly, a force (N) which the terminal-attached portion can withstand under impact tends be smaller than that of the main wire portion. Thus, the terminal-attached portion of the conductor in particular could be a weak point in terms of strength. For example, an electric wire may be subject to impact at the time of connection, such as, when the terminal of each terminal-fitted electric wire included in the above-described wire harness is inserted in a terminal hole to be mechanically connected to a connector housing, or when the connector housing is connected to an apparatus body or to another connector housing. Also, when the wire harness is attached to a certain portion of an automobile (or routed), for example, the electric wire may be subject to impact by touching adjacent components. Such impacts may cause the above-described terminal-fitted electric wire to break at and around the terminal-attached portion of the conductor, even if the terminal is firmly attached. As a result, an electrical connection cannot be maintained.

With recent improvements in performance and functionality of automobiles, the number of different types of on-vehicle electrical apparatuses and control apparatuses has been increased, and the number of electric wires to be used for these apparatuses is also on the increase. Accordingly, the weight of the electric wires is also on the increase. In order to protect the environment, however, reduction in weight of the electric wires is desired for the purpose of, for example, improvement in fuel consumption of automobiles. For example, using a thin wire material having a wire diameter of 0.5 mm or less as a conductor reduces the weight. With such a thin wire material, however, the terminal-attached portion of the crimp terminal or the like has a further smaller cross-sectional area, and thus is likely to withstand only a small force under impact. Therefore, such a thin wire material easily breaks at and around its terminal-attached portion when subject to impact.

In view of the above, one of the objects of the present invention is to provide a covered electric wire, a terminal-fitted electric wire, a copper alloy wire, and a copper alloy stranded wire which are excellent in terminal-fixing property and excellent in impact resistance even in a state where a terminal is attached thereto.

Advantageous Effects of the Present Disclosure

The above-described covered electric wire, terminal-fitted electric wire, copper alloy wire, and copper alloy stranded wire are excellent in terminal-fixing property, and excellent in impact resistance even in a state where a terminal is attached thereto.

DESCRIPTION OF EMBODIMENTS OF THE PRESENT INVENTION

First, embodiments of the present invention are enumerated.

(1) A covered electric wire according to one aspect of the present invention is a covered electric wire comprising an insulating coating layer on an outer side of a conductor, the conductor comprising a copper alloy consisting of:

not less than 0.05% by mass and not more than 2.0% by mass of Fe;

not less than 0.02% by mass and not more than 1.0% by mass of Ti;

not less than 0% by mass and not more than 0.6% by mass of Mg; and the balance being Cu and impurities, the covered electric wire being a stranded wire comprising a plurality of copper alloy wires stranded together, the plurality of copper alloy wires each having a work hardening coefficient of not less than 0.1 and a wire diameter of not more than 0.5 mm.

The stranded wire may be a stranded wire comprising a plurality of copper alloy wires simply stranded together, or may be a stranded wire that has been compression-molded after being stranded, i.e., a so-called compressed stranded-wire. Ditto for the copper alloy stranded wire of (9) described later.

The covered electric wire is excellent in terminal-fixing property and is also excellent in impact resistance even in a state where a terminal is attached thereto. The reason is as follows.

Fixing Property

In the covered electric wire, copper alloy wires (i.e., constituent wires of a conductor) each have a high work hardening coefficient. The covered electric wire can therefore be easily work-hardened when worked on with plastic working (e.g. compression forming). When a crimp terminal is crimped onto a conductor constituted of a stranded wire made up of such copper alloy wires, the terminal-attached portion is work-hardened by compression forming or plastic working that involves reduction in cross section. This work hardening enables the terminal to be firmly fixed.

Impact Resistance

The covered electric wire includes copper alloy wires which are easy to work-harden as a conductor, as described above, and therefore the covered electric wire exhibits a good effect of improving the strength based on the work hardening. For example, although the terminal-attached portion is smaller in cross-sectional area than the main wire portion in the above-described terminal-fitted electric wire, the effect of improving the strength based on work hardening can be sufficiently obtained. In particular, the above-described copper alloy wires (i.e., constituent wires) are thin wires each having a wire diameter of not more than 0.5 mm, and the terminal-attached portion thereof is further smaller in cross-sectional area. Even such copper alloy wires have sufficient strength due to the improvement of strength based on the above-described work hardening. Since the above-described terminal-fitted electric wire includes a stranded wire made up of such copper alloy wires as a conductor, it does not easily break when subject to impact, not only at the main wire portion (which is high in strength) thereof, but also at and around the terminal-attached portion thereof.

The covered electric wire includes, as a conductor, copper alloy wires comprising a copper alloy that is excellent in terminal-fixing property and in impact resistance in the terminal-attached state and that has a specific composition as described above. Therefore, the covered electric wire is high in strength, in toughness (e.g. elongation), and also in electrical conductivity. That is, the covered electric wire has a high strength, a high toughness, and a high electrical conductivity in good balance. The above-described covered electric wire includes a stranded wire made up of the copper alloy wires as a conductor. In this case, the conductor (stranded wire) tends to have better mechanical properties, such as a bending property and a twisting property, as a whole than a conductor composed of a single wire that has the same cross-sectional area. Therefore, a terminal-fitted electric wire which includes the covered electric wire does not easily break at and around its terminal-attached portion when the conductor is pulled while the wire is routed or connected to a housing, when the wire is bent or twisted, or even when the wire is repeatedly bent and twisted in use. Preferably, the terminal-attached portion may have about the same strength as the main wire portion. Such a covered electric wire can suitably be used as a terminal-fitted electric wire included in various types of wire harnesses, such as wire harnesses for automobiles. Further, such a terminal-fitted electric wire or wire harness can satisfactorily maintain the connection with a terminal, thus providing enhanced reliability.

Focusing on the strength, an annealed copper, which has been conventionally used as a conductor of an electric wire, is easy to work-harden and can be expected to improve in strength based on the work hardening, though it is inferior in strength. However, the work-hardened portion is still not strong enough because its original strength is low. Although alloying may generally provide improved strength, an alloy is difficult to work-harden and cannot be expected to exhibit a good effect of improving the strength based on work hardening. Unlike this, a work hardening coefficient, which has not been hitherto focused on, is used as an indicator here. Specifically, adjustments are made to the selection of the types of additive elements, their contents, the manufacturing conditions or the like for copper alloy wires constituting a conductor, so that the work hardening coefficient will satisfy a specific range. This can produce the covered electric wire excellent in terminal-fixing property and excellent in impact resistance in the terminal-attached state.

(2) As an example of the covered electric wire, the covered electric wire may be in the form in which the copper alloy contains more than 0.15% by mass of Mg.

Since this form contains a relatively large amount of Mg, the copper alloy wires constituting the conductor tends to have a high work hardening coefficient, thus satisfactorily providing the effect of improving the strength based on work hardening. Therefore, this form has an improved terminal-fixing property and impact resistance in the terminal-attached state.

(3) As an example of the covered electric wire, the covered electric wire may be in the form in which the copper alloy wires each have a tensile strength of not less than 350 MPa, an elongation at breakage of not less than 5%, and an electrical conductivity of not less than 55% IACS.

This form includes, as a conductor, copper alloy wires that are excellent in terminal-fixing property and in impact resistance in the terminal-attached state, and that are also high in tensile strength, in elongation at breakage, and in electrical conductivity. Thus, this form has a high strength, a high toughness, and a high electrical conductivity in good balance. Therefore, this form can suitably be used as the above-described terminal-fitted electric wire or the like.

(4) As an example of the covered electric wire, the covered electric wire may be in the form with a terminal-fixing strength of not less than 45 N. The terminal-fixing strength, the impact-resistant energy in the terminal-attached state (5), and a measuring method of the impact-resistant energy (6) will be described later.

This form enables a terminal to be firmly fixed and has an improved terminal-fixing property. Therefore, this form can suitably be used as the above-described terminal-fitted electric wire or the like.

(5) As an example of the covered electric wire, the covered electric wire may be in the form with an impact-resistant energy of not less than 2 J/m in a state where a terminal is attached to the covered electric wire.

This form has a high impact-resistant energy in a terminal-attached state where a terminal (e.g. crimp terminal) is crimped, and does not easily break at its terminal-attached portion when subject to impact in the terminal-attached state, thus excellent in impact resistance. Therefore, this form can suitably be used as the above-described terminal-fitted electric wire or the like.

(6) As an example of the covered electric wire, the covered electric wire may be in the form with an impact-resistant energy of not less than 5 J/m.

This form has a high impact-resistant energy and does not easily break when subject to impact. Therefore, this form can be used as the above-described terminal-fitted electric wire or the like and does not easily break when subject to impact.

(7) A terminal-fitted electric wire according to one aspect of the present invention comprises the covered electric wire according to any one of the above (1) to (6), and a terminal attached to an end of the covered electric wire.

Such a terminal-fitted electric wire, which includes the above-described covered electric wire, is excellent in terminal-fixing property and in impact resistance in the terminal-attached state, and that is also high in tensile strength, in elongation at breakage, and in electrical conductivity. Therefore, the terminal-fitted electric wire can suitably be used, for example, as various types of wire harnesses, such as a wire harness for an automobile.

(8) A copper alloy wire according to one aspect of the present invention is a copper alloy wire to be used as a conductor, the copper alloy wire comprising a copper alloy consisting of:

not less than 0.05% by mass and not more than 2.0% by mass of Fe;

not less than 0.02% by mass and not more than 1.0% by mass of Ti;

not less than 0% by mass and not more than 0.6% by mass of Mg; and the balance being Cu and impurities, the copper alloy wire having a work hardening coefficient of not less than 0.1, and a wire diameter of not more than 0.5 mm.

If such a copper alloy wire is used as a conductor of an electric wire for use with a terminal attached thereto as described above, it can form an electric wire excellent in terminal-fixing property and also excellent in impact resistance in the terminal-attached state, because of its high work hardening coefficient. Further, the copper alloy wire comprises a copper alloy having a specific composition, thus having a high strength, a high toughness, and a high electrical conductivity as described above. Therefore, the copper alloy wire, which may be a single wire or a stranded wire, can suitably be used as a conductor of an electric wire or the like. For example, such copper alloy wires may be stranded together into a stranded wire as a conductor to form a covered electric wire of the above (1).

(9) A copper alloy stranded wire according to one aspect of the present invention comprises a plurality of the copper alloy wires according to the above (8) stranded together.

Such a copper alloy stranded wire substantially maintains the composition and the properties of the above-described copper alloy wires. Thus, the copper alloy stranded wire is excellent in terminal-fixing property and in impact resistance in the terminal-attached state, and is also high in strength, in toughness, and in electrical conductivity. Further, the copper alloy stranded wire tends to have better mechanical properties than a single wire that has the same cross-sectional area, as described above. Therefore, the copper alloy stranded wire can suitably be used as a conductor of an electric wire or the like. For example, the copper alloy stranded wire used as a conductor can form a covered electric wire of the above (1).

DETAILS OF EMBODIMENT OF THE PRESENT INVENTION

An embodiment of the present invention is described below in detail with reference to the drawings as appropriate. In the drawings, identical characters refer to members having identical names. The content of element is expressed in % by mass unless otherwise specified.

[Copper Alloy Wire]

(Composition)

A copper alloy wire 1 in an embodiment is used as a conductor of an electric wire, such as a covered electric wire 3. One of the features of copper alloy wire 1 of an embodiment is that it comprises a copper alloy consisting of specific additive elements, the content of each element being within a specific range. The copper alloy is an Fe—Ti—Cu alloy or an Fe—Ti—Mg—Cu alloy containing: not less than 0.05% and not more than 2.0% of Fe; not less than 0.02% and not more than 1.0% of Ti; not less than 0% and not more than 0.6% of Mg; and the balance being Cu and impurities. The impurities refer to inevitable impurities.

First, each of the additive elements is described in detail.

Fe

Fe is mainly present as a precipitate in Cu, a matrix, and contributes to improvement in strength (e.g. tensile strength).

The content of Fe of not less than 0.05% can provide a high strength to copper alloy wire 1. Although depending on the manufacturing conditions, a higher Fe content tends to provide a higher strength to copper alloy wire 1. If, for example, an improved strength is desired, the content of Fe may be not less than 0.4%, or further not less than 0.6%, or not less than 0.8%.

The content of Fe of not more than 2.0% can reliably prevent formation of a bulky precipitate that contains Fe and Ti, thus reducing wire breakage originating from a bulky precipitate at the time of wiredrawing and bending. Although depending on the manufacturing conditions, a lower Fe content can more reliably prevent formation of such a bulky precipitate. If, for example, prevention of formation of a bulky precipitate (reduction in wire breakage) is desired, the content of Fe may be not more than 1.8%, or further not more than 1.6%, or not more than 1.4%.

Ti

Ti is mainly present as a precipitate along with Fe, and contributes to improvement in strength (e.g. tensile strength). Ti also contributes to prevention of reduction in electrical conductivity due to solid solution of Fe in Cu.

The content of Ti of not less than 0.02% can satisfactorily produce the above-described precipitate that contains Fe and Ti, thus enabling copper alloy wire 1 to have a high strength due to precipitation strengthening and to have a high electrical conductivity with the precipitation of Fe and Ti. Although depending on the manufacturing conditions, a higher Ti content tends to provide a higher strength to copper alloy wire 1. If, for example, an improved strength is desired, the content of Ti may be not less than 0.05%, or further not less than 0.1%, or not less than 0.2%.

The content of Ti of not more than 1.0% can prevent formation of a bulky precipitate that contains Fe and Ti as described above. Although depending on the manufacturing conditions, a lower Ti content can more reliably prevent formation of such a bulky precipitate. If, for example, prevention of formation of a bulky precipitate (reduction in wire breakage) is desired, the content of Ti may be not more than 0.9%, or further not more than 0.7%.

Mg

The copper alloy constituting copper alloy wire 1 of an embodiment may contain 0% of Mg, that is, may be in the form in which no Mg is contained. In this form, adjustments of the content of Fe, the content of Ti, and the manufacturing conditions can make the work hardening coefficient satisfy a specific range (see Test Example 1 below). Also, this form does not cause deterioration in workability which would occur if Mg is contained. Further, this form allows easy plastic working (e.g. wiredrawing) and is excellent in manufacturability.

However, the inventors of the present invention have conducted studies and have found that, if Mg is contained with the presence of Fe and Ti each within a specific content range, a large work hardening coefficient tends to be obtained, although depending on the manufacturing conditions. In view of this, the copper alloy constituting copper alloy wire 1 of an embodiment may be in the form in which Mg is contained (more than 0%). Although depending on the manufacturing conditions, a higher Mg content tends to provide a larger work hardening coefficient and more satisfactorily provide the effect of improving the strength based on work hardening, and thus improvement in terminal-fixing property and improvement in impact resistance in the terminal-attached state can be expected. Mg is mainly present as a solid solution in Cu, a matrix, and may contribute to improvement in strength (e.g. tensile strength). If, for example, an increase in work hardening coefficient is desired, the content of Mg may be not less than 0.02%, or further not less than 0.1%, or more than 0.14%. In particular, the content of Mg of more than 0.15% tends to provide a larger work hardening coefficient, thus satisfactorily providing the effect of improving the strength based on work hardening, although depending on the manufacturing conditions. Furthermore, the content of Mg may be not less than 0.2%.

If Mg is contained, the content of Mg of not more than 0.6% can curb the decline in electrical conductivity due to excessive solid solution of Mg in Cu, thus allowing copper alloy wire 1 to have a high electrical conductivity. Further, the content of Mg of not more than 0.6% can curb the deterioration in workability due to excessive solid solution of Mg, allows easy plastic working (e.g. wiredrawing), and provides excellent manufacturability. If, for example, a high electrical conductivity and an improved workability are desired, the content of Mg may be not more than 0.55%, or further not more than 0.5%, not more than 0.45%, or not more than 0.4%.

(Structure)

Examples of the structure of copper alloy constituting copper alloy wire 1 of an embodiment include a structure where precipitates or crystals containing Fe and Ti are dispersed. Examples of the precipitates or crystals include a compound such as $Fe_2Ti$. With such a structure, a high strength due to precipitation strengthening and a high electrical conductivity due to precipitation of Fe and Ti can be expected.

Further, examples of the structure of copper alloy include a microcrystal structure. With the microcrystal structure, the above-described precipitates are present in a uniformly dispersed manner, and thus an improved strength can be expected. Also, since the microcrystal structure contains little bulky crystal grain which could be an origin of breakage, breakage is less likely to occur and improvement in toughness (e.g. elongation) can be expected. Further, the microcrystal structure enables a terminal to be firmly fixed and satisfactorily provides a high terminal-fixing strength when copper alloy wire 1 of an embodiment is used as a conductor of an electric wire (e.g. covered electric wire 3) and a terminal (e.g. crimp terminal) is attached to the conductor.

In quantitative terms, the average crystal grain diameter of not more than 10 μm can satisfactorily provide the above-described effects. It may be not more than 7 μm, or further not more than 5 μm. The crystal grain diameter can be adjusted to a predetermined one by adjusting manufacturing conditions (e.g. the degree of working and/or the heat-treatment temperature, ditto as below) depending on, for example, the composition (the types of additive elements and/or their contents, ditto as below).

The average crystal grain diameter can be measured as described hereinafter. A cross section that has been worked on with a cross section polisher (CP) is observed with a scanning electron microscope. A range of observation having a predetermined area $S_0$ is taken from the observed image, and the number N of all the crystals present within the range of observation is counted. The area ($S_0$/N) obtained by dividing area $S_0$ by the number N of crystals is defined as an area Sg of each crystal grain, and the diameter of the circle having an area equivalent to area Sg of the crystal grain is defined as the diameter R of crystal grain. This diameter R of crystal grain is defined as an average crystal grain diameter. The range of observation may be a range where the number n of crystals is 50 or more, or may be the whole cross section. With such a sufficiently broad range of observation, errors due to substances other than crystals (e.g. precipitates) that could be present in area $S_0$ can be sufficiently reduced.

(Wire Diameter)

One of the features of copper alloy wire 1 of an embodiment is that its wire diameter is not more than 0.5 mm. Copper alloy wire 1 of an embodiment, which is a thin wire with a diameter of not more than 0.5 mm, can be suitably used as a conductor of an electric wire that should be light in weight, e.g., as a conductor of an electric wire to be placed in an automobile. The wire diameter may be not more than 0.35 mm, or further not more than 0.25 mm. The wire diameter can be adjusted to a predetermined one by adjusting, for example, the degree of working (reduction degree of the cross section) at the time of wiredrawing. If copper alloy wire 1 is a round wire, the wire diameter of copper alloy wire 1 refers to its diameter; whereas if its cross section has a shape other than a circle, the wire diameter refers to the diameter of a circle having an area equivalent to the area of the cross section.

(Cross-Section Shape)

The cross-section shape of copper alloy wire 1 of an embodiment can appropriately be selected. A typical example of copper alloy wire 1 is a round wire having a circular cross section. The cross-section shape varies depending on the shape of a die used for wiredrawing or the shape of a molding die if copper alloy wire 1 is a compressed stranded-wire. For example, copper alloy wire 1 may be a deformed wire having an elliptical cross section, polygonal (e.g. rectangular or hexagonal) cross section or the like.

(Work Hardening Coefficient)

One of the features of copper alloy wire 1 of an embodiment is, in qualitative terms, easiness of work hardening by plastic working; and, in quantitative terms, to have a work hardening coefficient of not less than 0.1.

The relation between a true stress $\sigma$ and a true strain $\varepsilon$ in a plastic strain region at the time of application of a uniaxial-direction test force of in a tensile test is expressed as the formula $\sigma=C\times\varepsilon^n$, and the work hardening coefficient is defined as an exponent n of true strain $\varepsilon$. In this formula, C denotes a strength parameter.

The exponent n can be obtained by conducting a tensile test using a commercially available tensile tester and creating an S-S curve (see also JIS G 2253 (2011)).

A larger work hardening coefficient is preferred because it makes work hardening easier and more satisfactorily provides the effect of improving the strength based on work hardening to a working portion. If, for example, copper alloy wire 1 is used as a conductor of an electric wire (e.g. covered electric wire 3) and a terminal (e.g. crimp terminal) is attached to the conductor by crimping or the like, then the terminal-attached portion is a working portion provided with plastic working (e.g. compression forming). The working portion, which has been provided with plastic working (e.g. compression forming) and thus reduced in cross section, has become harder and stronger than before the plastic working. Therefore, the working portion, i.e., the terminal-attached portion and its neighborhood of the conductor, is less likely to become a weak point in terms of strength. A work hardening coefficient of not less than 0.11, or not less than 0.12, or further not less than 0.15 is preferred because it can more satisfactorily provide the effect of improving the strength based on work hardening. Depending on the composition and/or the manufacturing conditions, the portion can be expected to maintain about the same strength as that of the main wire portion. Since the work hardening coefficient varies depending on the composition and/or the manufacturing conditions as described later, the upper limit is not particularly defined.

The work hardening coefficient varies depending on the manufacturing conditions if the same composition is the same (see Test Example 1 described later). Accordingly, the manufacturing conditions may be adjusted in accordance with the composition so that the work hardening coefficient, as an indicator, is not less than 0.1.

(Properties)

Tensile Strength, Elongation at Breakage, and Electrical Conductivity

Copper alloy wire 1 of an embodiment comprises a copper alloy having the above-described specific composition, and is manufactured so as to have a work hardening coefficient that satisfies a specific range. This enables copper alloy wire 1 of an embodiment to have a high strength, a high toughness, and a high electrical conductivity in good balance. In quantitative terms, copper alloy wire 1 may satisfy at least one of, preferably all of the three conditions: the tensile strength is not less than 350 MPa; the elongation at breakage is not less than 5%; and the electrical conductivity is not less than 55% IACS.

If an improved strength is desired, the tensile strength may be not less than 360 MPa, or not less than 370 MPa, or not less than 380 MPa, or further not less than 400 MPa.

If an improved toughness is desired, the elongation at breakage may be not less than 6%, or not less than 7%, or not less than 8%, or not less than 9.5%, or further not less than 10%.

If an improved electrical conductivity is desired, the electrical conductivity may be not less than 60% IACS, or not less than 65% IACS, or further not less than 70% IACS.

The tensile strength, the elongation at breakage, and the electrical conductivity can also be adjusted to predetermined ones by adjusting the composition and/or the manufacturing conditions. For example, increased contents of additive elements and/or an increased degree of wiredrawing (decreased wire diameter) tend to increase the tensile strength and tend to decrease the electrical conductivity. For example, if a heat treatment is performed after wiredrawing, an increased heat-treatment temperature tends to increase the elongation at breakage and tends to decrease the tensile strength and the electrical conductivity.

[Copper Alloy Stranded Wire]

Copper alloy wire 1 of an embodiment can be used as a constituent wire of a stranded wire. Copper alloy stranded wire 10 of an embodiment includes copper alloy wires 1 of an embodiment as constituent wires, and comprises a plurality of copper alloy wires 1 stranded together. Copper alloy stranded wire 10 tends to have a larger cross-sectional area, withstand a larger force under impact, and thus have a better impact resistance than a single constituent wire 1, while substantially maintaining the composition, structure, and properties of constituent copper alloy wires 1. Further, copper alloy stranded wire 10, when used as a conductor of an electric wire (e.g. covered electric wire 3), allows a terminal (e.g. crimp terminal) to be fixed more firmly to the conductor because copper alloy stranded wire 10 has a larger number of work-hardened constituent wires. Besides, copper alloy stranded wire 10 is also excellent in bending property and can be easily bent. Therefore, copper alloy stranded wire 10 does not easily break when, for example, routed. Although FIG. 1 illustrates copper alloy stranded wire 10 comprising seven wires stranded together, the number of wires for stranding may be changed as appropriate.

Copper alloy stranded wire 10 may be compression-molded into a compressed stranded-wire (not shown) after being stranded. If used as a conductor of an electric wire (e.g. covered electric wire 3), the compressed stranded-wire allows an insulating coating layer 2 to be easily formed around the outer circumference of the conductor, due to its excellent stability in the stranded state. Further, the compressed stranded-wire tends to be better in mechanical properties and also enables a smaller diameter than a simply stranded wire without compression.

The wire diameter, the cross-sectional area, the twist pitch and the like of copper alloy stranded wire 10 can appropriately be selected in accordance with, for example, the number of wires for stranding. If used as a conductor of an electric wire (e.g. covered electric wire 3), copper alloy stranded wire 10 that has a cross-sectional area of, for example, not less than 0.03 $mm^2$ enables a terminal (e.g. crimp terminal) to be firmly fixed to the conductor and can satisfactorily provide the effect of improving the strength based on work hardening. The cross-sectional area of not more than, for example, 0.5 $mm^2$ enables copper alloy stranded wire 10 to be light in weight. The twist pitch of not less than, for example, 10 mm enables easy stranding of constituent wires (copper alloy wires 1) even if they are thin wires of not more than 0.5 mm, thus providing good manufacturability of copper alloy stranded wire 10. The twist pitch of not more than, for example, 20 mm can prevent copper alloy stranded wire 10 from being untwisted when it is bent, thus providing a good bending property.

[Covered Electric Wire]

Copper alloy wire 1 or copper alloy stranded wire 10 of an embodiment may be used as-is as a conductor. However, copper alloy wire 1 or copper alloy stranded wire 10 provided with an insulating coating layer on its outer circumference would be excellent in insulating property. Covered electric wire 3 of an embodiment has insulating coating layer 2 on the outer side of a conductor, the conductor being copper alloy stranded wire 10. As a covered electric wire of another embodiment, the conductor may be copper alloy wire 1 (single wire). FIG. 1 illustrates a case in which copper alloy stranded wire 10 is provided as a conductor.

Examples of the insulating material constituting insulating coating layer 2 include polyvinyl chloride (PVC), non-halogen resin, and a material having excellent fire resistance. A known insulating material may be used.

The thickness of insulating coating layer 2 can appropriately be selected in accordance with a predetermined insulating strength, and is not particularly limited.

Terminal-Fixing Strength

Covered electric wire 3 of an embodiment includes, as a conductor, copper alloy stranded wire 10 made up of copper alloy wires 1 as constituent wires that exhibit a good effect of improving the strength based on work hardening as described above. Accordingly, in a state where a terminal (e.g. crimp terminal) is attached by crimping for example, the terminal can be firmly fixed. In quantitative terms, for example, the terminal-fixing strength satisfies not less than 45 N. A larger terminal-fixing strength is preferred because it can more firmly fix the terminal and more reliably maintain the connection state between covered electric wire 3 (conductor) and the terminal. More preferably, the terminal-fixing strength is not less than 50 N, or not less than 55 N, or further not less than 60 N. The upper limit is not particularly defined.

Impact-Resistant Energy in Terminal-Attached State

Covered electric wire 3 of an embodiment includes, as a conductor, copper alloy stranded wire 10 made up of copper alloy wires 1 as constituent wires that exhibit a good effect of improving the strength based on work hardening as described above. Accordingly, covered electric wire 3, when subject to impact with a terminal (e.g. crimp terminal) being attached thereto, does not easily break at and around its terminal-attached portion that has been provided with plastic working (e.g. crimping). In quantitative terms, for example, the impact-resistant energy in a state where a terminal is attached (the impact-resistant energy in a terminal-attached state) satisfies not less than 2 J/m. A larger impact-resistant energy in the terminal-attached state is preferred because it makes breakage less like to occur at and around the terminal-attached portion under impact. Preferably, the impact-resistant energy in the terminal-attached state is not less than 3 J/m, or further not less than 4 J/m. The upper limit is not particularly defined.

Impact-Resistant Energy

In covered electric wire 3 of an embodiment, not only the terminal-attached portion as described above, but also the conductor (copper alloy stranded wire 10) itself do not easily break when subject to impact, and are thus excellent in impact resistance. In quantitative terms, for example, the impact-resistant energy (hereinafter also referred to as an impact-resistant energy of the main wire) satisfies not less than 5 J/m. The main wire having a larger impact-resistant energy is preferred because it is less likely to break when subject to impact. Preferably, the impact-resistant energy of the main wire is not less than 6 J/m, or further not less than 7 J/m. The upper limit is not particularly defined.

The terminal-fixing strength and the impact-resistant energy in the terminal-attached state of covered electric wire 3 of an embodiment can be adjusted to predetermined ones by adjusting the composition and/or the manufacturing conditions of copper alloy wires 1 used as constituent wires of the conductor so that the work hardening coefficient of copper alloy wires 1 satisfies a specific range as described above. The impact-resistant energy of the main wire can be adjusted to a predetermined one by adjusting the composition and/or the manufacturing conditions of copper alloy wires 1 so that, for example, copper alloy wires 1 are high in both tensile strength and elongation at breakage.

In the case of a covered electric wire including a single copper alloy wire 1 as a conductor, it is also preferred that at least one of the terminal-fixing strength, the impact-resistant energy in the terminal-attached state, and the impact-resistant energy of the main wire satisfy the above-described ranges. In the case of copper alloy wire 1 and copper alloy stranded wire 10 as described above not having insulating coating layer 2, it is also preferred that at least one of the terminal-fixing strength, the impact-resistant energy in the terminal-attached state, and the impact-resistant energy of the main wire satisfy the above-described ranges.

[Terminal-Fitted Electric Wire]

Figure 2:
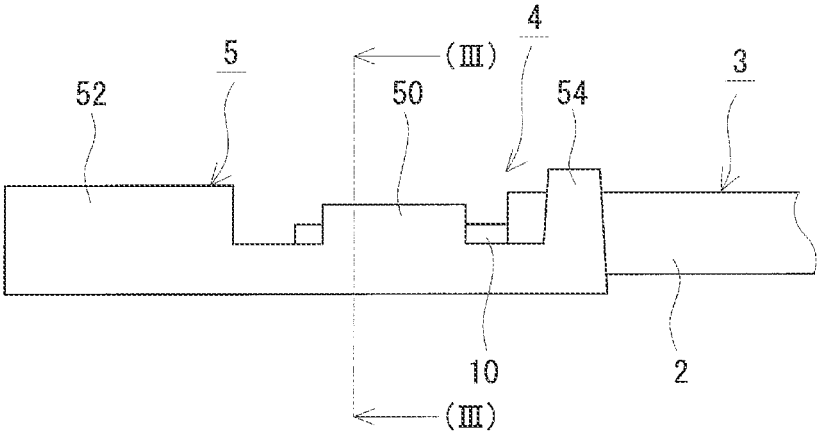
FIG. 2 is a schematic side view showing an area around a terminal of a terminal-fitted electric wire in an embodiment.

Covered electric wire 3 of an embodiment can be used as a terminal-fitted electric wire having a terminal (e.g. crimp terminal) attached to its end. Terminal-fitted electric wire 4 of an embodiment includes covered electric wire 3 of an embodiment and a terminal 5 attached to an end of covered electric wire 3. FIG. 2 illustrates a crimp terminal, as terminal 5, having one end provided with a female-type or male-type fit portion 52, the other end provided with an insulation barrel portion 54 for holding insulating coating layer 2, and an intermediate portion provided with a wire barrel portion 50 for holding a conductor (copper alloy stranded wire 10 in FIG. 2). The crimp terminal is crimped onto an end of the conductor, which is exposed by stripping insulating coating layer 2 away at the end of covered electric wire 3. The crimp terminal is thus electrically and mechanically connected to the conductor. A terminal-fitted electric wire of another embodiment may include a covered electric wire having the above-described copper alloy wire 1 (single wire) as the conductor.

Terminal 5 is, for example, of a crimping type such as a crimp terminal, or of a molten type for connection with a molten conductor. Terminal-fitted electric wire 4 of an embodiment includes, as a conductor, copper alloy stranded wire 10 including copper alloy wires 1 which exhibit a good effect of improving the strength based on work hardening. Therefore, the use of a crimp terminal as terminal 5 is preferred because it can satisfactorily provide the effect of good impact resistance in the terminal-attached state.

Terminal-fitted electric wire 4 may be in the form in which one terminal 5 is attached to each covered electric wire 3 as shown in FIG. 2, or may be in the form in which one terminal 5 is provided for a plurality of covered electric wires 3. That is, terminal-fitted electric wire 4 may be in the form in which it includes one covered electric wire 3 and one terminal 5, or in which it includes a plurality of covered electric wires 3 and one terminal 5, or in which it includes a plurality of covered electric wires 3 and a plurality of terminals 5. If a plurality of electric wires are included, bundling them with a binding tool or the like enables easy handling of terminal-fitted electric wire 4. Since copper alloy wires 1 and copper alloy stranded wire 10 constituting the conductor are excellent in harness workability (e.g. attachability of terminal), terminal-fitted electric wire 4 can be used as a constituent component of various wire harnesses, such as a wire harness for an automobile.

[Properties of Copper Alloy Wire, Copper Alloy Stranded Wire, Covered Electric Wire, and Terminal-Fitted Electric Wire]

Constituent wires of copper alloy stranded wire 10, constituent wires constituting a conductor of covered electric wire 3, and constituent wires constituting a conductor of terminal-fitted electric wire 4 of an embodiment each maintain the composition, structure, and properties of copper alloy wire 1 or have about the same properties as those of copper alloy wire 1. For example, each of the constituent wires may be in the form with a tensile strength of not less than 350 MPa, an elongation at breakage of not less than 5%, and an electrical conductivity of not less than 55% IACS.

The electrical conductivity of covered electric wire 3 and terminal-fitted electric wire 4 may be measured with the conductor being exposed. For measurement of the terminal-fixing strength and the impact-resistant energy in the terminal-attached state of terminal-fitted electric wire 4, a terminal (e.g. crimp terminal) included in terminal-fitted electric wire 4 itself can be used.

Advantageous Effects

Covered electric wire 3 of an embodiment comprises a copper alloy having a specific composition, and includes, as a conductor, copper alloy wire 1 of an embodiment having a work hardening coefficient that satisfies a specific range, or includes copper alloy stranded wire 10 of an embodiment comprising copper alloy wires 1 stranded together. Accordingly, if a terminal (e.g. crimp terminal) is attached by crimping for example, the terminal can be firmly fixed with an excellent terminal-fixing property. In addition, the terminal-attached portion, which has been provided with plastic working (e.g. crimping), has an improved strength based on work hardening. Therefore, the wire does not easily break at and around its terminal-attached portion under impact in a state where the terminal is attached thereto, and thus has an excellent impact resistance. Terminal-fitted electric wire 4 of an embodiment, which includes covered electric wire 3 of an embodiment, is excellent in terminal-fixing property and is also excellent in impact resistance in the terminal-attached state. Copper alloy wire 1 and copper alloy stranded wire 10 of an embodiment used as a conductor of an electric wire (e.g. covered electric wire 3) can form an electric wire excellent in terminal-fixing property and in impact resistance in the terminal-attached state. The effects of the terminal-fixing property and the impact resistance in the terminal-attached state will be specifically described with reference to Test Example 1.

[Manufacturing Method]

Copper alloy wire 1, copper alloy stranded wire 10, covered electric wire 3, and terminal-fitted electric wire 4 of an embodiment can be manufactured by a manufacturing method including, for example, the following steps. The outline of each step is enumerated hereinafter.

(Copper Alloy Wire)

<Continuous Casting Step>

A continuous casting is performed with a molten metal of the copper alloy having the above-described specific composition to manufacture a cast material.

<Wiredrawing Step>

A wiredrawing is performed on the cast material, or on a worked material which is obtained by working on the cast material, to manufacture a wiredrawn material.

<Heat Treatment Step>

A heat treatment is performed on the wiredrawn material to manufacture a heat-treated material. The heat treatment is performed under the condition that the wire material after the heat treatment will have a work hardening coefficient of not less than 0.1.

(Copper Alloy Stranded Wire)

For manufacturing copper alloy stranded wire 10, a stranding step described hereinafter is included in addition to the above-described <Continuous Casting Step>, <Wiredrawing Step>, and <Heat Treatment Step>.

If a compressed stranded-wire is to be manufactured, a compressing step described hereinafter is further included.

<Stranding Step>

A plurality of wiredrawn materials or a plurality of heat-treated materials described above are stranded together to manufacture a stranded wire.

<Compressing Step>

The stranded wire is compression-molded into a predetermined shape to manufacture a compressed stranded-wire.

The above-described <Heat Treatment Step> is performed on the stranded wire constituted of the wiredrawn materials, or on the compressed stranded-wire which is obtained by compression-molding the stranded wire.

The above-described <Heat Treatment Step> may further be performed on the stranded wire constituted of the heat-treated materials, or on the compressed stranded-wire which is obtained by compression-molding the stranded wire.

Alternatively, the above-described <Heat Treatment Step> is omissible after the stranding step and/or after the compressing step because the <Heat Treatment Step> has already been performed.

Besides, the <Heat Treatment Step> may be performed on a soft-material stranded wire comprising soft materials stranded together, the soft materials being obtained by performing a softening heat treatment on the wiredrawn materials. Alternatively, the <Heat Treatment Step> may be performed on a soft-material compressed stranded-wire obtained by compression-molding the soft-material stranded wire.

(Covered Electric Wire)

In the case of manufacturing covered electric wire 3 or a covered electric wire that includes a single copper alloy wire 1, a covering step is included. The covering step forms an insulating coating layer on the outer circumference of a copper alloy wire (copper alloy wire 1 of an embodiment) made by the above-described manufacturing method of the copper alloy wire, or on the outer circumference of a copper alloy stranded wire (copper alloy stranded wire 10 of an embodiment) made by the above-described manufacturing method of the copper alloy stranded wire. Known techniques, such as extrusion coating and powder coating, may be used as a method for forming the insulating coating layer.

(Terminal-Fitted Electric Wire)

A crimping step is included for attaching a terminal to the conductor exposed by stripping the insulating coating layer away at an end of the covered electric wire (e.g. covered electric wire 3 of an embodiment) made by the above-described manufacturing method of the covered electric wire.

The continuous casting step, the wiredrawing step, and the heat treatment step are described hereinafter in detail.

<Continuous Casting Step>

In this step, a cast material is produced by performing a continuous casting with a molten metal of the copper alloy that has a specific composition containing Fe and Ti (and Mg, if needed) in specific content ranges as described above.

In typical copper alloy wire 1 of an embodiment, Fe and Ti are present as a precipitate, and Mg (if contained) is present as a solid solution. Accordingly, it is preferred that the manufacturing process of copper alloy wire 1 include a process for forming a supersaturated solid solution. Performing a separate solution-treatment step for a solution treatment enables a supersaturated solid solution to be formed at any desired time. It has been found however that, if the continuous casting is performed with a sufficiently high cooling rate for producing a cast material with a supersaturated solid solution, the resulting copper alloy wire 1 is finally excellent in mechanical and electrical properties, exhibits a good effect of improving the strength based on work hardening, and is suitable as a conductor of covered electric wire 3 or the like, without a separate solution-treatment step. In view of this, it is proposed that the continuous casting be performed in the manufacturing method of copper alloy wire 1, and in particular, quenching be performed with a sufficiently high cooling rate in the cooling process.

As a method for continuous casting, various methods including the belt and wheel method, the twin belt method, and the upcast method can be used. In particular, the upcast method is preferred because it can reduce impurities such as oxygen, and can reliably prevent oxidation of Cu and additive elements. The cooling rate in the cooling process is preferably more than 5° C./sec, or more than 10° C./sec, or 15° C./sec or more.

Various types of working, such as plastic working and cutting may be performed on the cast material. Examples of the plastic working include conform extrusion and rolling (hot rolling, warm rolling, and cold rolling). Examples of the cutting include stripping. Performing such working can reduce surface defects on the cast material and can reduce wire breakage at the time of wiredrawing, thus improving productivity. For an upcast material in particular, such working is preferably performed.

A heat treatment under the conditions below can be performed on the worked material. The heat treatment can, for example, remove strains due to the working. Depending on the heat treatment conditions, artificial aging described later may be performed.

The worked material is larger in cross-sectional area (thicker) than the final wire diameter of copper alloy wire 1. Therefore, it is considered that the heat treatment is suitable for batch processing which allows easy management of the heating state of the whole object of heating. Examples of the heat treatment conditions are as follows:

Heat-Treatment Temperature: not less than 400° C. and not more than 650° C., and preferably not less than 450° C. and not more than 600° C.; and Retention Time: not less than 1 hour and not more than 40 hours, and preferably not less than 3 hours and not more than 20 hours.

<Wiredrawing Step>

This step performs a wiredrawing (cold rolling) on a material, such as the cast material and the worked material, in at least one pass or typically in a plurality of passes, thereby producing a wiredrawn material having a predetermined final wire diameter. In the case of a plurality of passes, the degree of working for each pass may be adjusted as appropriate in accordance with the composition and the final wire diameter. Also, in the case of a plurality of passes, an intermediate heat treatment may be performed between passes. The intermediate heat treatment can remove strains as described above and enables artificial aging. As to the conditions of the intermediate heat treatment, reference may be made to the heat treatment conditions applied to the worked material described above.

<Heat Treatment Step>

A purpose of the heat treatment of this step is: artificial aging for generating a precipitate containing Fe and Ti, from a copper alloy that typically contains the additive elements in a solid-solution state; and softening for improving the elongation of the wiredrawn material work-hardened by the wiredrawing to a final wire diameter. Further, another purpose is to adjust the work hardening coefficient to a specific range in manufacturing copper alloy wire 1. The heat treatment enables a terminal to be firmly fixed, and can produce copper alloy wire 1 and copper alloy stranded wire 10 that are excellent in impact resistance in the terminal-attached state, that are high in strength, in toughness, and in electrical conductivity, and that are thus suitable for a conductor of covered electric wire 3 or the like. The heat treatment which is performed after the wiredrawing step with the purpose of the artificial aging, the softening, and the adjustment of the work hardening coefficient may be hereinafter referred to as a final heat treatment.

In the case of batch processing, examples of the conditions of the final heat treatment to achieve the above purposes are as follows:

Heat-Treatment Temperature: not less than 400° C. and not more than 650° C., and preferably not less than 450° C. and not more than 600° C.; and Retention Time: not less than 1 hour and not more than 40 hours, and preferably not less than 3 hours and not more than 20 hours.

The conditions may be selected from the above described ranges in accordance with, for example, the composition (the type of additive elements and their contents) and the working state. As a specific example, reference may be made to Test Example 1 below.

A higher heat-treatment temperature within the above-described range with the same composition tends to improve the impact-resistant energy in the terminal-attached state, the impact-resistant energy, and the elongation at breakage. A lower heat-treatment temperature can inhibit the growth of crystal grain and tends to improve the tensile strength. Sufficient formation of the above-described precipitate tends to improve the electrical conductivity.

If the above-described conform extrusion is performed on the cast material, the temperature range of the final heat treatment is preferably not less than 200° C. and not more than 600° C.

The above-described final heat treatment may be performed as continuous processing. The continuous processing allows objects of heating to be supplied into a heating furnace continuously and is thus suitable for mass production. The conditions (the linear velocity, and the temperature in a furnace in the case of a furnace type, or the current value in the case of an energizing type) of the continuous processing may be adjusted so as to achieve the above-described purposes.

If a heat treatment is performed before the final heat treatment to also serve as the above-described artificial aging, adjustments may be made to the conditions of the final heat treatment from the above-described conditions, for the purpose of the softening and the adjustment of the work hardening coefficient. Such adjustments can inhibit the growth of crystal grain and satisfactorily forms a microcrystal structure, thus providing a high strength and a high elongation. This final heat treatment can use the batch processing or the continuous softening processing. The conditions of the continuous softening processing may be adjusted so as to achieve the above-described purposes.

Test Example 1

Copper alloy wires having various compositions, and covered electric wires that include the obtained copper alloy wires as conductors were produced under various manufacturing conditions, and their properties were examined.

Copper alloy wires were manufactured in the four manufacturing patterns (A) to (D) described below. Covered electric wires were manufactured as described below using the wire materials manufactured with manufacturing patterns (A) to (D). In each of the manufacturing patterns, a cast material as described hereinafter was prepared.

(Cast Material)

As raw materials, an electrolytic copper (having a purity of 99.99% or more), a mother alloy containing each additive element shown in Table 1 or an elemental metal of each additive element shown in Table 1 were prepared. The prepared raw materials were air-melted with a crucible made of high-purity carbon (with impurities of 20 ppm by mass or less) to produce a molten metal of copper alloy. The compositions of the copper alloy (the balance Cu and impurities) are shown in Table 1. The hyphen "-" represents "none" (0% by mass).

The molten metal of the copper alloy and a mold made of high-purity carbon (with impurities of 20 ppm by mass or less) were used to produce a cast material circular in cross section and having each of the following wire diameters, with the upcast method. The cooling rate was more than 10° C./sec. The use of a crucible or mold made of high-purity carbon can reliably reduce impurities.

(Manufacturing Patterns of Copper Alloy Wires)

(A) continuous casting (wire diameter φ 9.5 mm)→wiredrawing (wire diameter φ 0.16 mm)→heat treatment (temperatures (° C.) in Table 1, retention time of 8 hours)

(B) continuous casting (wire diameter φ 12.5 mm)→conform extrusion (wire diameter φ 9.5 mm)→wiredrawing (wire diameter φ 0.16 mm)→heat treatment (temperatures (° C.) in Table 1, retention time of 8 hours)

(C) continuous casting (wire diameter φ 12.5 mm)→cold rolling (wire diameter φ 9.5 mm)→heat treatment (x)→stripping (wire diameter φ 8 mm)→wiredrawing (wire diameter φ 0.16 mm)→heat treatment (temperatures (° C.) in Table 1, retention time of 8 hours)

(D) continuous casting (wire diameter φ 9.5 mm)→wiredrawing φ 2.6 mm)→heat treatment (x)→wiredrawing φ 0.16 mm)→heat treatment (continuous softening)

For heat treatment (x), the heat-treatment temperature was set to a temperature selected from the range of not less than 400° C. and not more than 600° C., and the retention time was set to a time selected from the range of not less than 4 hours and not more than 16 hours.

The heat treatment (continuous softening) was performed using an energizing-type continuous furnace, and the current value or the like was adjusted so that the work hardening coefficient would be not less than 0.1.

(Manufacturing Process of Covered Electric Wire)

Similarly to the steps shown in the above-described manufacturing patterns (A) to (D), seven wiredrawn materials having a wire diameter of φ 0.16 mm were produced and stranded together, and then compression-molded into a compressed stranded-wire having a cross-sectional area of 0.13 $mm^2$ (0.13 sq). The wiredrawn materials that were used were not subjected to the final heat treatment shown in each of the above-described patterns (A) to (D), and the produced compressed stranded-wire was subjected to a heat treatment (temperatures (° C.) in Table 1, retention time of 8 hours, or continuous softening). On the outer circumference of the obtained heat-treated material, a polyvinyl chloride (PVC) was extruded into a thickness of 0.2 mm to form an insulating coating layer, thereby producing a covered electric wire.

(Measurement of Properties)

Regarding the copper alloy wires manufactured by manufacturing patterns (A) to (D), the electrical conductivity (% IACS), the tensile strength (MPa), the elongation at breakage (%), and the work hardening coefficient were examined. The results are shown in Table 1.

The electrical conductivity (% IACS) was measured by the bridge method.

The tensile strength (MPa), the elongation at breakage (%), and the work hardening coefficient were each measured with a general-purpose tensile tester in accordance with JIS Z 2241 (the method for metallic material tensile test, 1998).

Regarding the produced covered electric wires, the terminal-fixing strength (N), the impact-resistant energy in the terminal-attached state (J/m, impact resistance E in the terminal-attached state), and the impact-resistant energy (J/m, impact resistance E) were examined. The results are shown in Table 2.

Figure 3:
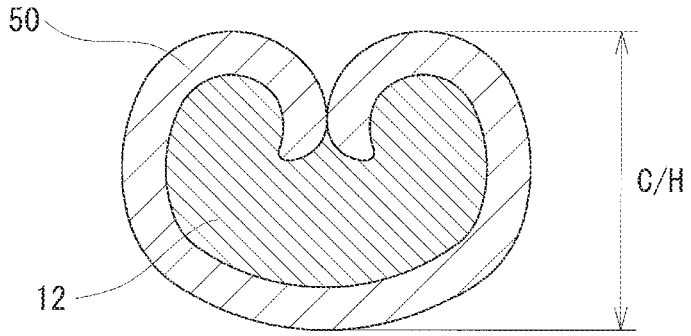
FIG. 3 is a cross-sectional view of the terminal-fitted electric wire shown in FIG. 2 taken along the cutting-plane line (III)-(III).

The terminal-fixing strength (N) were measure in the following way. The insulating coating layer was stripped at one end of the covered electric wire to expose the compressed stranded-wire as a conductor, and a terminal was attached to the end of this compressed stranded-wire. Here, a commercially-available crimp terminal was used as the terminal crimped onto the compressed stranded-wire. Further, as shown in FIG. 3, the crimp height C/H was adjusted so that the proportion of the cross-sectional area of terminal-attached portion 12 of the conductor (compressed stranded-wire) to the cross-sectional area of the main wire portion other than the terminal-attached portion would be the value (compressibility of residual conductor, 70% or 80%) shown in Table 2.

With the use of a general-purpose tensile tester, the maximum load (N) under which the terminal was not pulled off when pulled at 100 mm/min was measured. This maximum load is defined as the terminal-fixing strength.

The impact-resistant energy (J/m or (N/m)/m) was measured in the following way. A weight was attached to the leading end of the covered electric wire, the weight was lifted by 1 m and thereafter allowed to fall freely. The maximum weight (kg) of the weight under which breakage of the covered electric wire did not occur was measured, and the product of this weight and the gravitational acceleration (9.8 $m/s^2$) and the fall distance was divided by the fall distance. The resultant quotient ((weight×9.8×1)/1) is defined as the impact-resistant energy.

Figure 4:
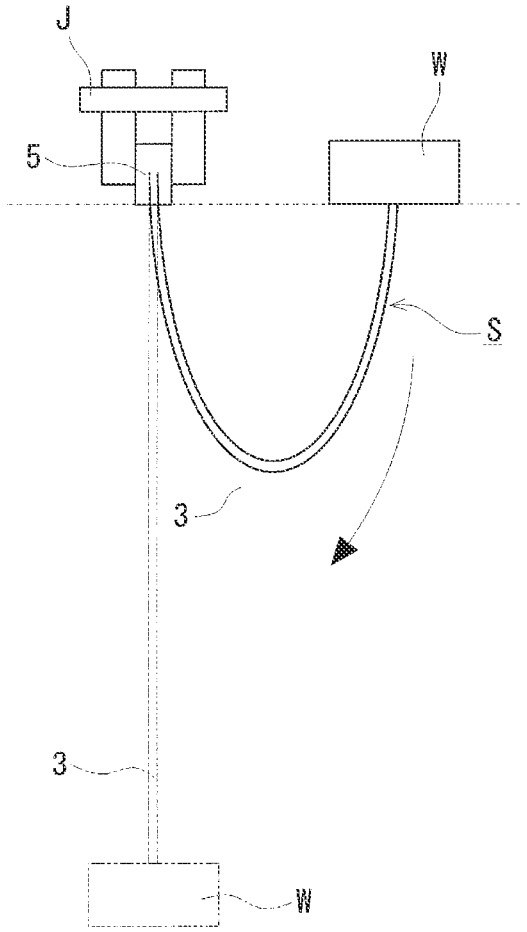
FIG. 4 illustrates a method for measuring an "impact-resistant energy in a terminal-attached state" in Test Example 1.

The impact-resistant energy (J/m or (N/m)/m) in the terminal-attached state was measured in the following way. Similarly to the measurement of the above-described terminal-fixing strength, a sample S (1 m in length here), which was a covered electric wire with terminal 5 (a crimp terminal here) being attached to its one end, was prepared. Terminal 5 was fixed with a jig J as shown in FIG. 4. A weight W was attached to the other end of sample S, weight W was lifted to the position where terminal 5 was fixed, and thereafter allowed to fall freely. Similarly to the above-described impact-resistant energy, the maximum weight of the weight W under which breakage of the covered electric wire did not occur was measured, and ((weight×9.8×1)/1) is defined as the impact-resistant energy in the terminal-attached state.

TABLE 1

| Sample | Composition Additive Element (% by mass) | | | | Heat Treatment | Electrical Conductivity | Tensile Strength | Elongation at Breakage | Work Hardening |
|---|---|---|---|---|---|---|---|---|---|
| No. | Fe | Ti | Mg | Process | ° C. × 8 h | % IACS | MPa | % | Coefficient |
| 1-1 | 1 | 0.45 | — | A | 450 | 81 | 506 | 10 | 0.1 |
| 1-2 | 1 | 0.45 | 0.3 | A | 500 | 69 | 494 | 14 | 0.17 |
| 1-3 | 1 | 0.45 | 0.3 | A | 550 | 66 | 420 | 15 | 0.2 |
| 1-4 | 1 | 0.5 | 0.042 | B | 480 | 85 | 505 | 12 | 0.13 |
| 1-5 | 1.1 | 0.47 | 0.21 | B | 500 | 72 | 484 | 12 | 0.16 |
| 1-6 | 0.65 | 0.3 | 0.05 | C | 500 | 85 | 458 | 12 | 0.15 |
| 1-7 | 0.65 | 0.3 | — | C | 500 | 89 | 382 | 17 | 0.2 |
| 1-8 | 0.1 | 0.05 | 0.3 | A | 400 | 67 | 475 | 8 | 0.12 |
| 1-9 | 0.1 | 0.05 | 0.3 | A | 450 | 74 | 371 | 19 | 0.28 |
| 1-10 | 1.2 | 0.3 | 0.05 | A | 500 | 72 | 426 | 15 | 0.2 |
| 1-11 | 1.3 | 0.6 | — | A | 500 | 85 | 415 | 17 | 0.18 |
| 1-12 | 1.3 | 0.6 | — | D | Continuous Softening | 67 | 388 | 12 | 0.15 |
| 1-13 | 1 | 0.45 | — | A | 500 | 88 | 383 | 18 | 0.18 |
| 1-14 | 1 | 0.45 | — | A | 500 | 88 | 383 | 18 | 0.18 |
| 1-101 | 1 | 0.45 | — | A | 400 | 66 | 567 | 3 | 0.08 |
| 1-102 | 0.65 | 0.3 | 0.05 | A | 450 | 74 | 601 | 6 | 0.07 |

TABLE 2

| Sample | Composition Additive Element (% by mass) | | | | Heat Treatment | Compressibility of Residual Conductor | Terminal-Fixing Strength | Impact Resistance E in Terminal-Attached State | Impact Resistance E |
|---|---|---|---|---|---|---|---|---|---|
| No. | Fe | Ti | Mg | Process | ° C. × 8 h | % | N | J/m | J/m |
| 1-1 | 1 | 0.45 | — | A | 450 | 80 | 63 | 3 | 8.3 |
| 1-2 | 1 | 0.45 | 0.3 | A | 500 | 70 | 61 | 4.7 | 10.6 |
| 1-3 | 1 | 0.45 | 0.3 | A | 550 | 70 | 53 | 6.5 | 10.6 |
| 1-4 | 1 | 0.5 | 0.042 | B | 480 | 80 | 64 | 5 | 8.5 |
| 1-5 | 1.1 | 0.47 | 0.21 | B | 500 | 80 | 63 | 7.5 | 10.4 |
| 1-6 | 0.65 | 0.3 | 0.05 | C | 500 | 70 | 50 | 3.6 | 8.7 |
| 1-7 | 0.65 | 0.3 | — | C | 500 | 70 | 46 | 5.3 | 9.4 |
| 1-8 | 0.1 | 0.05 | 0.3 | A | 400 | 80 | 61 | 4.3 | 9.8 |
| 1-9 | 0.1 | 0.05 | 0.3 | A | 450 | 70 | 49 | 7 | 9.8 |
| 1-10 | 1.2 | 0.3 | 0.05 | A | 500 | 70 | 54 | 6.7 | 9.8 |
| 1-11 | 1.3 | 0.6 | — | A | 500 | 70 | 54 | 6.4 | 10.8 |
| 1-12 | 1.3 | 0.6 | — | D | Continuous Softening | 70 | 55 | 3.5 | 7 |
| 1-13 | 1 | 0.45 | — | A | 500 | 70 | 45 | 4.9 | 10.3 |
| 1-14 | 1 | 0.45 | — | A | 500 | 80 | 48 | 8.1 | 10.3 |
| 1-101 | 1 | 0.45 | — | A | 400 | 70 | 64 | 1.8 | 9.3 |
| 1-102 | 0.65 | 0.3 | 0.05 | A | 450 | 70 | 63 | 1.5 | 6.2 |

Table 2 shows that each of Samples No. 1-1 to No. 1-14 is excellent in terminal-fixing property and is also excellent in impact resistance in the terminal-attached state, compared with Samples No. 1-101 and No. 1-102. In quantitative terms, Samples No. 1-1 to No. 1-14 each have a terminal-fixing strength of not less than 45 N, many of the samples having not less than 50 N, some of the samples having not less than 55 N or not less than 60 N. Also, Samples No. 1-1 to No. 1-14 each have an impact-resistant energy in the terminal-attached state of not less than 2 J/m, many of the samples having not less than 3 J/m, some of the samples having not less than 3.5 J/m, or further not less than 4 J/m. One conceivable reason for such results is that, since a copper alloy wire comprises a copper alloy, as a conductor, that has a specific composition containing Fe and Ti (and Mg, if needed) in the above-described specific content ranges and that has a high work hardening coefficient, the copper alloy wire exhibits an effect of improving the strength based on work hardening when the terminal-attached portion is worked on with plastic working (e.g. compression forming). This is supported by, for example, a comparison between Samples No. 1-2 and No. 1-102 having different work hardening coefficients. As shown in Table 1, Sample No. 1-2 is smaller in tensile strength than Sample No. 1-102 by about 20 percent. However, as shown in Table 2, Sample No. 1-2 is about the same in terminal-fixing strength as Sample No. 1-102 and is significantly larger in impact-resistant energy in the terminal-attached state even though the compressibility of residual conductor (compression-forming state) is the same. Thus, it is considered that Sample No. 1-2 compensates the smallness in tensile strength with the work hardening.

Further, it is shown that the work hardening coefficient varies by adjusting the composition and the manufacturing conditions. For example, a comparison between the group of Samples No. 1-1, No. 1-13, and No. 1-101; the group of Samples No. 1-2 and No. 1-3; and the group of Samples No. 1-8 and No. 1-9, the samples having the same composition for each group, shows that Samples No. 1-3, No. 1-13, and No. 1-9, with high temperatures (550° C., 500° C., and 450° C., respectively) in the final heat treatment, exhibit high work hardening coefficients. A comparison between Samples No. 1-6 and No. 1-102 as a pair having the same composition shows that the work hardening coefficient can be made high by applying different manufacturing conditions. Further, in this test, a comparison between Samples No. 1-11 and No. 1-12 as a pair having the same composition shows that the work hardening coefficient can be high if the heat treatment is performed as continuous processing; and a comparison in the group of Samples No. 1-5, No. 1-6, and No. 1-12 shows that the work hardening coefficient can be adjust to about the same level under different compositions and/or manufacturing conditions.

A comparison between Samples No. 1-1 and No. 1-2 shows that Sample No. 1-2, which contains Mg, is higher in work hardening coefficient although they have about the same tensile strength. Although Sample No. 1-2 has a compressibility of residual conductor of 70% and its degree of compression forming is higher than that of Sample No. 1-1, Sample No. 1-2 is about the same in terminal-fixing strength as Sample No. 1-1 and is larger in impact-resistant energy in the terminal-attached state than Sample No. 1-1. A conceivable reason is that Sample No. 1-2 has a high work hardening coefficient and thus appropriately work-hardened by compression forming. This shows that the presence of Mg would provide a high work hardening coefficient. It is also shown that, with the presence of Mg (see, for example, a comparison between Samples No. 1-6 and No. 1-7), and with a higher content of Mg (see, for example, a comparison between Samples No. 1-4 and No. 1-5), a higher elongation at breakage would be obtained. Further, this test shows that a higher temperature in the final heat treatment tends to provide a higher impact-resistant energy in the terminal-attached state.

Further, Table 2 shows that Samples No. 1-1 to No. 1-14, each of which includes a copper alloy wire comprising a copper alloy having a specific composition, has a high impact-resistant energy at its main wire. This means that the wire material (compressed stranded-wire here) itself is excellent in impact resistance. In quantitative terms, Samples No. 1-1 to No. 1-14 each have an impact-resistant energy of the main wire of not less than 5 J/m, or further not less than 7 J/m, or not less than 8 J/m, some of the samples having not less than 9 J/m.

In addition, Table 1 shows that the copper alloy wires of Samples No. 1-1 to No. 1-14, each of which comprises a copper alloy having a specific composition, has a high strength, a high toughness, and a high electrical conductivity in good balance. In quantitative terms, the copper alloy wires of Samples No. 1-1 to No. 1-14 each have a tensile strength of not less than 350 MPa, an elongation at breakage of not less than 5%, and an electrical conductivity of not less than 55% IACS. Focusing on the tensile strength, the copper alloy wires here each have a tensile strength of not less than 370 MPa, many of the samples having not less than 400 MPa, some of the samples having not less than 420 MPa or even not less than 450 MPa. Focusing on the elongation at breakage, the copper alloy wires here each have an elongation at breakage of not less than 8%, many of the samples having not less than 9% or further not less than 9.5%, some of the samples having not less than 10%. Focusing on the electrical conductivity, the copper alloy wires here each have an electrical conductivity of not less than 65% IACS, many of the samples having not less than 68% IACS, some of the samples having not less than 70% IACS. Covered electric wires of Samples No. 1-1 to No. 1-14, each of which includes, as a conductor, a stranded wire made up of such copper alloy wires having a high strength, a high toughness, and a high electrical conductivity in good balance, also substantially maintain the above-described high tensile strength, high elongation at breakage, and high electrical conductivity, thus having a high strength, a high toughness, and a high electrical conductivity in good balance. It is shown, therefore, that a copper alloy wire and a copper alloy stranded wire; and a covered electric wire and a terminal-fitted electric wire including the copper alloy wire or the copper alloy stranded wire as a conductor which have a high strength, a high toughness, and a high electrical conductivity in good balance can be produced by adjusting their composition to a specific composition and by adjusting the manufacturing conditions so that the work hardening coefficient will be not less than 0.1.

From the results of Table 1, if the copper alloy wire contains not less than 0.1% by mass and not more than 1.3% by mass of Fe, not less than 0.05% by mass and not more than 0.6% by mass of Ti, and not more than 0.3% by mass of Mg, and has a work hardening coefficient of not less than 0.1, then the electrical conductivity can be not less than 66% IACS, the tensile strength can be not less than 371 MPa, and the elongation at breakage can be not less than 8%. If the content of Fe is not less than 0.65% by mass and not more than 1.3% by mass, then the tensile strength can be not less than 382 MPa and the elongation at breakage can be not less than 10%. If the content of Ti is not less than 0.3% by mass and not more than 0.6% by mass, similar effects can be obtained. If the work hardening coefficient is not less than 0.15, the elongation at breakage can be not less than 12%. If the work hardening coefficient is not less than 0.17, the elongation at breakage can be not less than 14%. If the work hardening coefficient is not less than 0.2, the elongation at breakage can be not less than 15%.

From the results of Table 2, if the copper alloy wire contains not less than 0.1% by mass and not more than 1.3% by mass of Fe, not less than 0.05% by mass and not more than 0.6% by mass of Ti, and not more than 0.3% by mass Mg, and has a compressibility of residual conductor of not less than 70%, then the terminal-fixing strength can be not less than 45 N, the impact-resistant energy in the terminal-attached state can be not less than 3 J/m, and the impact-resistant energy can be not less than 7 J/m. If the work hardening coefficient is not less than 0.1, similar effects can be obtained. If the content of Mg is not less than 0.05% by mass, the impact-resistant energy in the terminal-attached state can be not less than 3.6 J/m and the impact-resistant energy can be not less than 8.5 J/m. If the content of Mg is not less than 0.21% by mass, the impact-resistant energy in the terminal-attached state can be not less than 4.3 J/m and the impact-resistant energy can be not less than 9.8 J/m.

In other respects, the correlation between the tensile strength and the terminal-fixing strength being examined from this test, it is considered that a higher tensile strength tends to provide a higher terminal-fixing strength. The correlation between the elongation at breakage and the impact-resistant energy in the terminal-attached state being examined, it is considered that a higher elongation at breakage tends to provide a higher impact-resistant energy in the terminal-attached state.

The present invention is not limited to the examples shown above but is defined by the terms of the claims, and is intended to encompass any modifications within the meaning and scope equivalent to the terms of the claims.

For example, the composition of the copper alloy of Test Example 1, the wire diameter of the copper alloy wire, the number of wires for stranding, and/or the heat treatment conditions may be changed as appropriate.

INDUSTRIAL APPLICABILITY

The covered electric wire of the present invention can be used in a state where a terminal is attached to its end, for example, as a wire portion of transportation machines (e.g. automobiles and airplanes), and various electrical apparatuses such as control apparatuses (e.g. industrial robots). The terminal-fitted electric wire of the present invention can be used for a wire of various electrical apparatuses, such as transportation machines and control apparatuses as mentioned above. In particular, the covered electric wire of the present invention and the terminal-fitted electric wire of the present invention can suitably be used for components of various wire harnesses, such as wire harnesses for automobiles. The copper alloy wire of the present invention and the copper alloy stranded wire of the present invention each can be used as a conductor of an electric wire, such as a covered electric wire as mentioned above.

REFERENCE SIGNS LIST

1: copper alloy wire; 10: copper alloy stranded wire; 3: covered electric wire; 4: terminal-fitted electric wire; 12: terminal-attached portion; 2: insulating coating layer; 5: terminal; 50: wire barrel portion; 52: fit portion; 54: insulation barrel portion; S: sample; J: jig; W: weight

The invention claimed is:

1. A covered electric wire comprising an insulating coating layer on an outer side of a conductor, the conductor comprising a copper alloy consisting of:

not less than 0.05% by mass and not more than 2.0% by mass of Fe;

not less than 0.02% by mass and not more than 1.0% by mass of Ti;

not less than 0% by mass and not more than 0.6% by mass of Mg; and a balance being Cu and impurities, the covered electric wire being a stranded wire comprising a plurality of copper alloy wires stranded together, the plurality of copper alloy wires each having a work hardening coefficient of not less than 0.18 and a wire diameter of not more than 0.5 mm.

2. The covered electric wire according to claim 1, wherein the copper alloy contains more than 0.15% by mass of Mg.

3. The covered electric wire according to claim 1, wherein the plurality of copper alloy wires each have a tensile strength of not less than 350 MPa, an elongation at breakage of not less than 5%, and an electrical conductivity of not less than 55% IACS.

4. The covered electric wire according to claim 1, wherein the covered electric wire has a terminal-fixing strength of not less than 45 N.

5. The covered electric wire according to claim 1, wherein the covered electric wire has an impact-resistant energy of not less than 2 J/m in a state where a terminal is attached to the covered electric wire.

6. The covered electric wire according to claim 1, wherein the covered electric wire has an impact-resistant energy of not less than 5 J/m.

7. A terminal-fitted electric wire comprising:

the covered electric wire according to claim 1; and a terminal attached to an end of the covered electric wire.

8. A copper alloy wire to be used as a conductor, the copper alloy wire comprising a copper alloy consisting of:

not less than 0.05% by mass and not more than 2.0% by mass of Fe;

not less than 0.02% by mass and not more than 1.0% by mass of Ti;

not less than 0% by mass and not more than 0.6% by mass of Mg; and a balance being Cu and impurities, the copper alloy wire having a work hardening coefficient of not less than 0.18, and a wire diameter of not more than 0.5 mm.

9. A copper alloy stranded wire comprising a plurality of the copper alloy wires according to claim 8 stranded together.

* * * * *